US007530400B2

(12) United States Patent
Telfer

(10) Patent No.: US 7,530,400 B2
(45) Date of Patent: May 12, 2009

(54) DOWNHOLE TOOL FOR SELECTIVELY CATCHING BALLS IN A WELL BORE

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 0 days.

(21) Appl. No.: 10/552,888

(22) PCT Filed: Apr. 20, 2004

(86) PCT No.: PCT/GB2004/001698

§ 371 (c)(1),
(2), (4) Date: Mar. 8, 2007

(87) PCT Pub. No.: WO2004/094779

PCT Pub. Date: Nov. 4, 2004

(65) Prior Publication Data

US 2007/0272412 A1 Nov. 29, 2007

(30) Foreign Application Priority Data

Apr. 22, 2003 (GB) ..... 0309038.8

(51) Int. Cl.
*E21B 34/06* (2006.01)

(52) U.S. Cl. ..... 166/373; 166/193; 166/243; 166/318

(58) Field of Classification Search ..... 166/373, 166/193, 242.1, 318, 243
See application file for complete search history.

(56) References Cited

U.S. PATENT DOCUMENTS

| | | | | |
|---|---|---|---|---|
| 2,737,244 | A | 3/1956 | Baker et al. | |
| 4,420,040 | A | 12/1983 | Arbasak et al. | |
| 4,856,591 | A * | 8/1989 | Donovan et al. | 166/278 |
| 4,893,678 | A * | 1/1990 | Stokley et al. | 166/374 |
| 5,127,472 | A | 7/1992 | Watson et al. | |
| 5,141,053 | A | 8/1992 | Restarick et al. | |
| 5,244,044 | A | 9/1993 | Henderson | |
| 5,335,727 | A | 8/1994 | Cornette et al. | |
| 5,392,862 | A | 2/1995 | Swearingen | |
| 5,533,573 | A * | 7/1996 | Jordan et al. | 166/313 |
| 6,170,578 | B1 | 1/2001 | Edwards et al. | |
| 6,336,507 | B1 * | 1/2002 | Collins | 166/313 |
| 2004/0040719 | A1 * | 3/2004 | Vincent et al. | 166/373 |

FOREIGN PATENT DOCUMENTS

WO WO 2004/088091 A1 10/2004

* cited by examiner

*Primary Examiner*—David J Bagnell
*Assistant Examiner*—Robert E Fuller
(74) *Attorney, Agent, or Firm*—Osha • Liang LLP

(57) ABSTRACT

A ball catcher for selectively catching and retaining drop balls in a well bore. The catcher is located on a workstring. A main bore (18) axially through the catcher is restrained to provide first (26) and second (28) bores of differing diameters. The first bore (26) is further restricted at a lower end, thus balls within the first bore (26) are retained and balls in the second bore (28) pass through the catcher. The bores preferably overlap to provide a channel (30) so that smaller balls can pass between the bores for release. In one embodiment, the second bore (28*a*) is located centrally through the catcher so that wireline tools and the like can be run through the catcher.

17 Claims, 3 Drawing Sheets

DOWNHOLE TOOL FOR SELECTIVELY CATCHING BALLS IN A WELL BORE

This application claims priority from PCT/GB2004/001698, having an international filing date of 20 Apr. 2004, and a priority date of 22 Apr. 2003.

The present invention relates to downhole tools for use in oil and gas wells and in particular, though not exclusively, to a downhole tool for selectively catching drop balls in a well bore.

It is well known in the art to use drop balls to perform functions within a well bore. Resilient balls, typically made of rubber, have been used to wipe the inner surface of the well bore or tool string as the ball moves downwardly or to separate fluids. Hard balls, typically made of steel, are used to reset tools by blocking flow through the tool and by a build up of pressure, causing movement of one part of the tool in relation to another. An example of such a tool is a circulation tool, wherein radial ports are provided in the tool body and in a sleeve within the tool body. The sleeve is fixed in position with the ports misaligned so that fluid flow is initially through a central bore of the tool. A drop ball is released into the tool string and by sealing against the sleeve, causes the sleeve to move relative to the body. On movement the radial ports align and fluid is now jetted radially from the tool. Improvements to these tools have been on providing mechanisms where the ball can fall through the tool so that the tool can be cyclic in operation.

Once a drop ball is released from a tool or has completed its function in a well bore it is necessary to catch or retain the drop ball in the tool string so that it may be brought back up to the surface. Simple ball catchers merely comprise a bar or pin extending across the central bore of the tool string providing a bypass for fluid but preventing the balls from travelling any further. The main disadvantage of such catchers are that after a number of balls are caught fluid flow is impeded as the fluid has to travel in a tortuous path around the balls.

U.S. Pat. No. 5,127,472 discloses a ball catcher which allows fluid flow around the balls, by providing a tube within the tool string into which the balls locate. The tube includes radially ports so that fluid can flow from the central bore out of the tube, into an annulus between the tube and the tool string. This ball catcher is limited to operating only with resilient balls. Further this ball catcher cannot be used in a tool string where a tool located below the ball catcher requires to be operated by a ball.

Applicants co-pending UK Patent Application 0308080.1 discloses an actuating mechanism wherein drop balls can actuate a first tool in a tool string, then be released and actuate a second tool below the first tool. The main disadvantage of this mechanism is that the second tool must be operated at the time the drop ball is released from the first tool. This limits the Application to use in sequentially operated tools.

It is an object of the present invention to provide a ball catcher for use in a tool string which selectively retains drop balls or allows them to pass through the catcher.

It is a further object of the present invention to provide a ball catcher for use in a tool string which includes a bypass for fluid and allows selected drop balls to pass therethrough.

It is a further object of at least one embodiment of the present invention to provide a ball catcher for use in a tool string which includes a bore which a wireline or tubing deployed tool can pass therethrough.

According to a first aspect of the present invention there is provided a ball catcher for selectively retaining drop balls in a tool string, the ball catcher comprising a substantially cylindrical body having a main bore running axially therethrough, at least a portion of the main bore being restrained to a first and a second bore running axially therethrough, the first and second bores being parallel and wherein the first bore includes restriction means at an end thereof.

Preferably the first and second bores are partially overlapping to provide a channel therebetween.

Thus a ball of a first diameter falling into the first bore will be retained if the diameter is greater than the width of the channel. If the first diameter is equal to or less than the width of the channel it will move to the second bore and be released from the catcher. The second bore provides free passage through the catcher for fluid, and selected drop balls.

Preferably the main bore is located centrally on the body. In this way the first and second bores can be provided on a cylindrical insert, held by a pin or other retaining means.

Preferably the portion of the main bore includes an entry port. More preferably the entry port has a first aperture equal to the diameter of the first bore and a second aperture having a diameter less than the diameter of the first bore, the apertures being aligned with the first and second bores respectively. In this way larger balls are directed towards the first bore for retention in the catcher, while smaller balls can fall through the second bore.

Advantageously the entry port is inclined with respect to the main bore. In this way balls can run into the first aperture.

Preferably the second aperture has a diameter substantially equal to the width of the channel.

Preferably the restraining means is a third bore coaxially aligned with the first bore and having a diameter less than the diameter of the first bore.

Advantageously the second bore is located centrally on the body. Thus the main bore and second bore may be coaxial. Such an embodiment provides for passage of a wireline or other tubing deployed tool through the ball catcher.

According to a second aspect of the present invention there is provided a method of selectively retaining drop balls in a tool string, comprising the steps:

(a) inserting in a tool string a ball catcher including a first bore having retaining means and a second bore passing therethrough, the bores including an overlapping portion to provide a channel therebetween;

(b) dropping a first ball of a first diameter through the tool string;

(c) directing the first ball into the first bore; and (d) retaining the first ball in the first bore.

Preferably the method further includes the steps of:

(a) dropping a second ball of a second diameter, the second diameter being smaller than the first diameter through the tool string;

(b) directing the second ball into the first bore;

(c) passing the second ball through the channel into the second bore; and (d) releasing the second ball from the ball catcher into the tool string.

Optionally the method may further include the steps:

(a) dropping a second ball of a second diameter, the second diameter being smaller than the first diameter through the tool string;

(b) passing the second ball through the second bore; and (c) releasing the second ball from the ball catcher into the tool string.

Further the method may include the step of passing a tool through the second bore into the tool string below the ball catcher.

Preferably the method includes the step of actuating a tool above the ball catcher with the first ball. Preferably also the method includes the step of actuating a tool below the ball catcher with the second ball.

Preferably also the steps may be repeated in any sequence. Thus a first tool located above a second tool can be actuated after the second tool is actuated.

It will be appreciated that although reference is made in relative terms to upper and lower, top and bottom, that the present invention could be used in a well bore which is vertical, inclined or horizontal wherein the drop balls are carried by fluid pressure.

An embodiment of the present invention will now be described, by way of example only, with reference to the following drawings of which:

Figure 1:
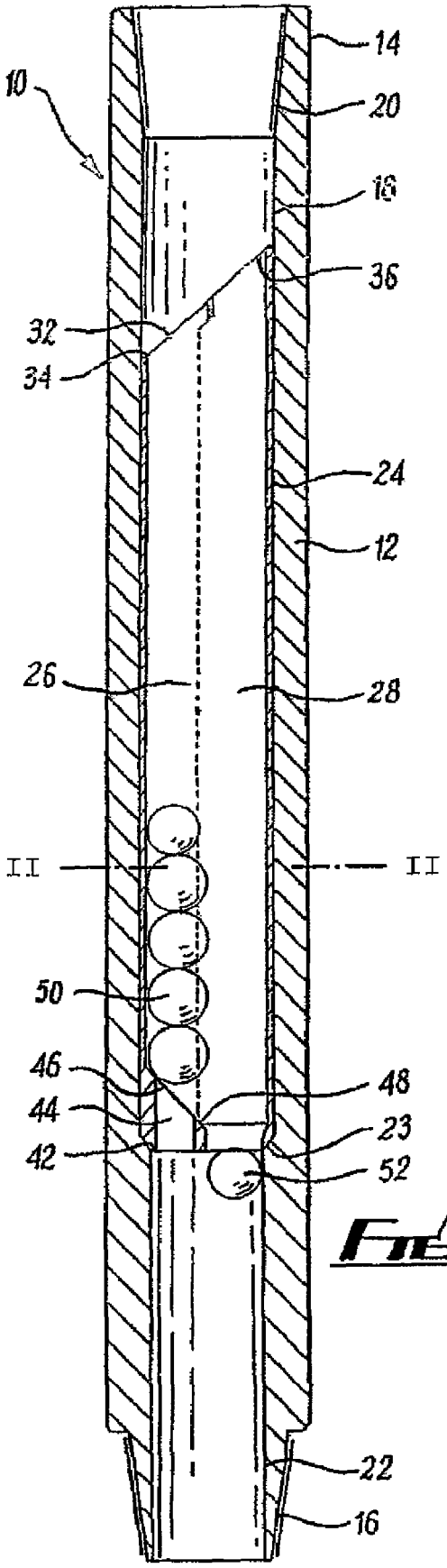
FIG. 1 is a cross-sectional view through a ball catcher according to an embodiment of the present invention.

Reference is initially made to FIG. 1 of the drawings which illustrates a ball catcher, generally indicated by reference numeral 10, in accordance with an embodiment of the present invention. Tool 10 includes a cylindrical body 12 having an upper end 14, a lower end 16 and a cylindrical bore 18 running therethrough. In this embodiment, bore 18 is located centrally through the tool 10. The body 12 has a box section 20 located at the upper end 14 and a pin section 22 located at the lower end 16 for connecting the tool 10 in a tool string, work string or drill string (not shown).

Figure 3:
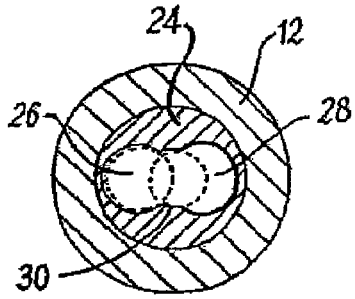
FIG. 3 shows a sectional view though the ball catcher of FIG. 1 at line II-II.

Within the cylindrical bore 18 there is located an inner cylindrical body 24. The inner body 24 fills the bore 18. The inner body 24 is held in place by abutting a shoulder 23 in the bore 18 on the body 12. Within the body 24 are two cylindrical bores, a first bore 26 and a second bore 28. Referring now to FIG. 3 where the bores are shown more clearly in cross-section. The second bore 28 has a greater diameter than the first bore 26. The bores 26,28 overlap to provide a channel 30 between them. Thus an object having a diameter smaller than the width of the channel 30 can pass between the bores 26,28.

At the upper end 14 of the tool there is located a plate 32. Plate 32 can further be seen with the aid of FIG. 2. Plate 32 is located across the top of the first and second bores 26,28. Plate 32 is inclined to the central bore 18. The angle of inclination is approximately 45 degrees. The low side 34 of the plate 32 is above the first bore 26 and the high side 36 of the plate is above the second bore 28. In this way any drop ball landing on the plate 32 will fall towards the low side 34 and the first bore 26. Plate 32 includes two circular apertures 38,40. Aperture 38 is aligned with the first bore 26 and has a diameter equal to the diameter of the first bore 26. Aperture 40 is smaller in diameter than aperture 38 and smaller in diameter than the first bore 26. Thus only drop balls having a diameter equal to or less than the diameter of the second aperture 40 can pass through it. The second aperture 40 is aligned with the second bore 28. In a preferred embodiment the diameter of aperture 40 is equal to the width of the channel 30.

Towards the lower end 16, at the bottom 42 of the first bore 26, there is located a third bore 44. Third bore 44 is located co-axially with the first bore 26. Third bore 44 has a diameter which is smaller than the diameter of the first bore 26. An upper surface 46 of the third bore 44 is also inclined, but with a low side 48 directed towards the second bore 28. The surface 46 may provide a keyhole profile to aid the passage of fluid through the ball catcher 10.

Though the bores 26,28 are shown parallel to, but off-set from the axis of the central bore 18, it will be appreciated that the bores 26,28 can be located anywhere in the central bore 18. Thus in a further embodiment the second bore 28 is located centrally and co-axially with the central bore 18 to provide a central passage running axially through the ball catcher. This is illustrated in FIG. 4, this embodiment provides for the passage of tools through the ball catcher 10.

Figure 2:
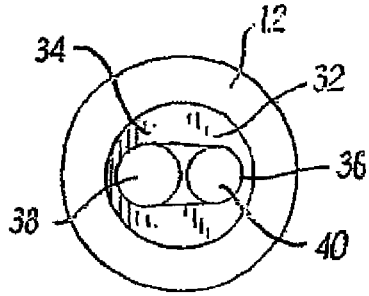
FIG. 2 is a view through the ball catcher of FIG. 1 from above.
Figure 4:
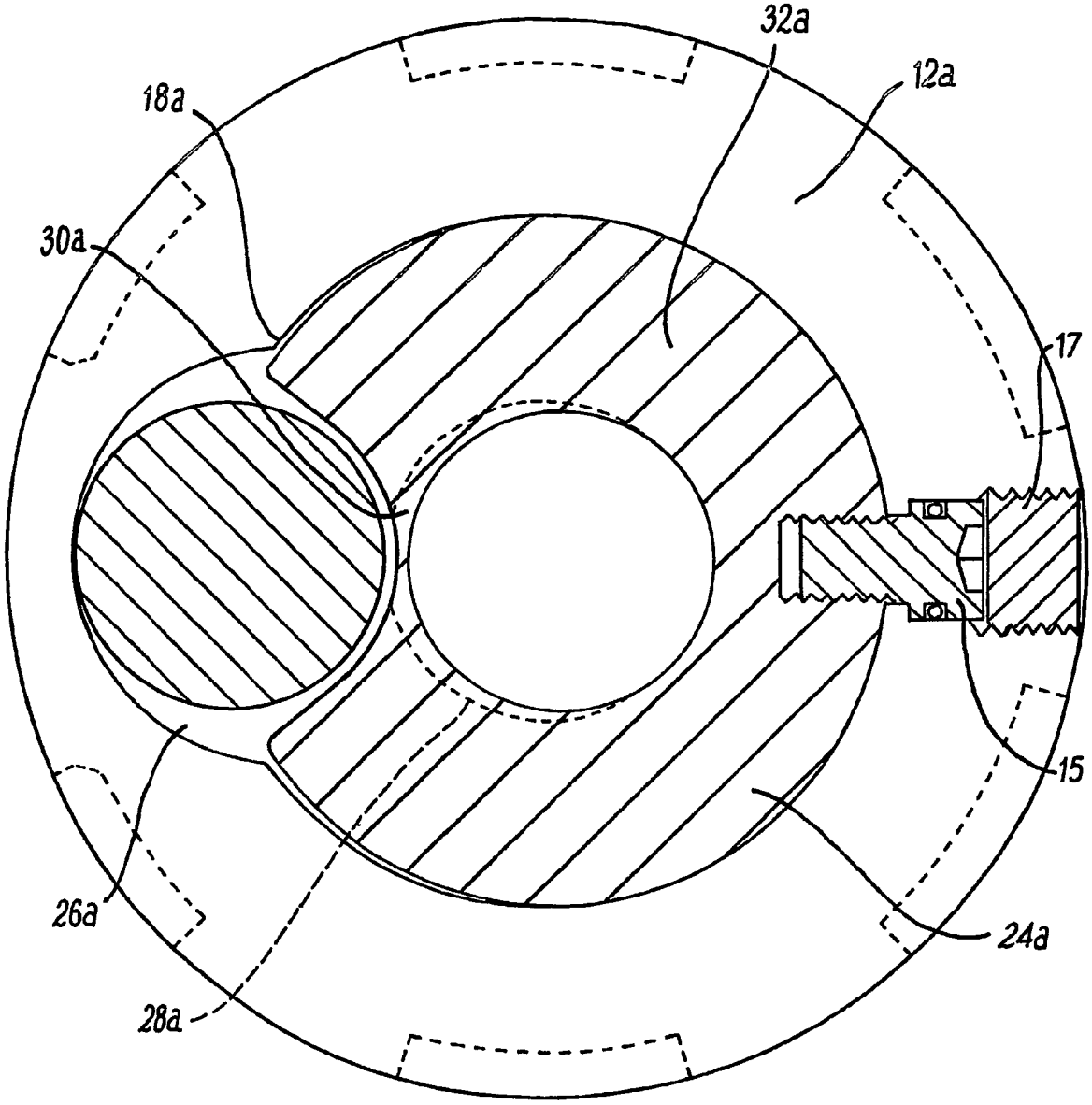
FIG. 4 is a sectional view through a ball catcher according to an alternative embodiment of the present invention.

Referring to FIG. 4, like parts to those of FIGS. 1 to 3 have been given the same reference numeral with the suffix "a". The second bore 28*a* is located centrally to the body 12*a*. This has resulted in the insert 24*a* extending over part of the bore and having a semi-cylindrical or scalloped portion removed to provide the first bore 26*a*. The first bore 26*a* extends eccentrically into the wall of the body 12*a*. This is required due to the dimensions of the ball(s)/wireline tools to be used. The insert 24*a* is now held in place by an orientating/locking pin 15 located through the body 12*a* and screwed into the insert 24*a*. A teflon plug 17 is located behind the pin.

In this embodiment, the channel 30*a* is insufficient for balls to pass therebetween and, as a result, this embodiment is limited to providing a central bore 28*a* for the passage of tools and/or balls having a diameter equal to or less than the diameter of the second bore 28*a*. Balls of a larger diameter enter the first bore 26*a* and will be held in this bore by restriction means at an end (not shown).

In use, ball catcher 10 is located in a tool string using the box section 20 and the pin section 22. Fluid can pass through the ball catcher 10 using bores 18, 28, 28 and/or 44, thus an unimpeded flow path is provided.

When a ball 50 enters the ball catcher 10 at the upper end 14, it will be forced against plate 32. As the diameter of the ball 50 is greater than the diameter of the aperture 40, the ball 50 will slide down the face of plate 32 and fall through aperture 38. The ball 50 then falls through the first bore 26 and is prevented from moving across the channel 30 to second bore 28 as its diameter is greater than the width of the channel 30. At the end 42 of the first bore 26, the ball 50 will be stopped at the upper surface 46 of the third bore 44 as the diameter of the ball 50 is greater than the diameter of the third bore 44. The ball 50 is thus retained in the ball catcher 10. As can be seen in FIG. 1, a number of balls having a similar diameter to ball 50 can be retained in the ball catcher 10.

When a ball 52 enters the ball catcher 10 at the upper end 14, it will be forced against plate 32. As the diameter of the ball 52 is equal to the diameter of the aperture 40, the ball 52 will fall through aperture 40 if it meets plate 32 on the high side 36. However, if the ball 52 meets the plate 32 on the low side 34, it will fall through the larger aperture 40. If the ball 52 has fallen through the aperture 40 it will enter the second bore 28 where it has an unimpeded path through the ball catcher 10 for release out of the ball catcher 10 at the lower end 16. If the ball 52 falls through the aperture 38 it will pass into the first bore 26. From the first bore 26 it may move through the channel 30 as its diameter is smaller than the width of the channel 30, and enter the second bore 28. From here the it has an unimpeded path through the ball catcher 10 for release out of the ball catcher 10 at the lower end 16. If the ball 52 rests in the first bore 26, it can be urged into the second bore by rotating the ball catcher 10 by virtue of rotation of the tool string.

Thus the passage of a ball through the ball catcher is selectively determined from the diameter of the ball relative to the diameter of the smaller aperture 40 and the width of the channel 30.

Figure 5:
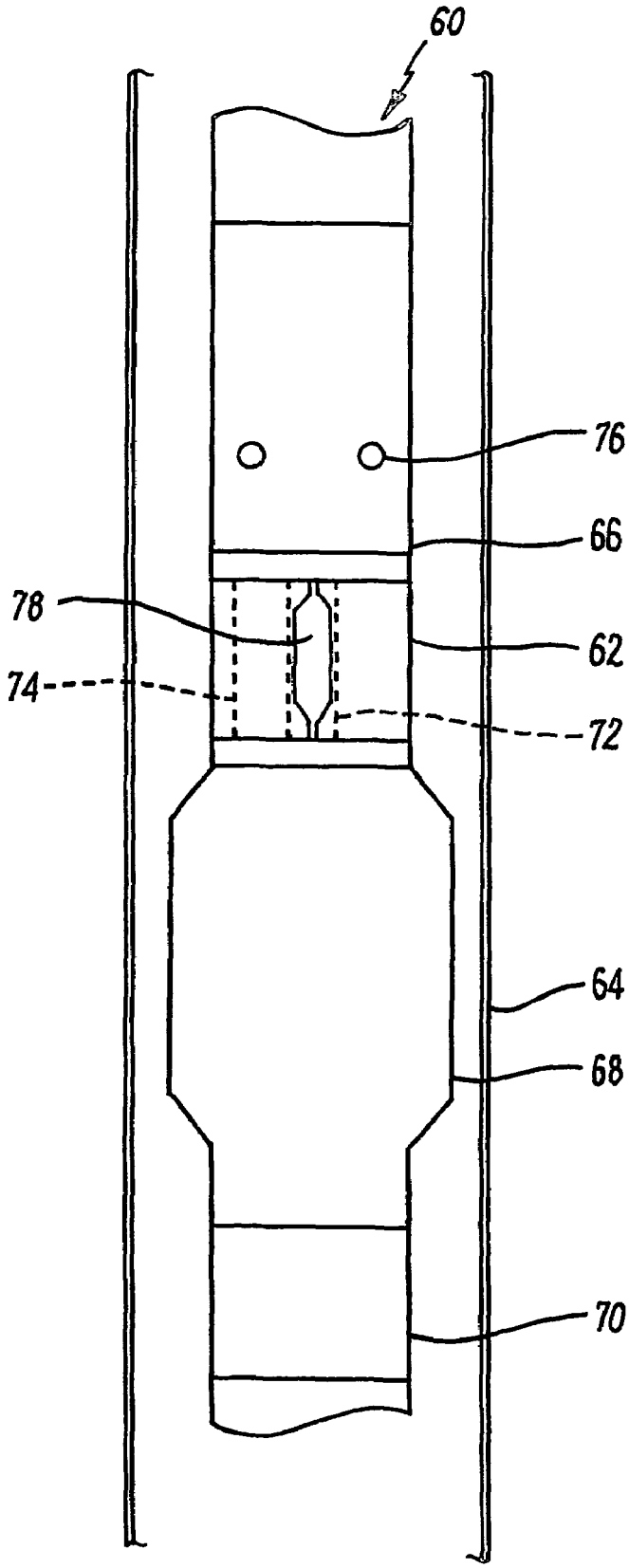
FIG. 5 is a schematic view of a tool string including the embodiment of a ball catcher as in FIG. 4.

Reference is now made to FIG. 5 of the drawings which illustrates a tool string, generally indicated by reference numeral 60, including a ball catcher 62 according to an embodiment of the present invention, located in a well bore 64. Tool string 60 also includes a drop ball activated circulation tool 66, a drop ball activated packer 68 and a conventional ball catcher 70. Ball catcher 62, part shown in cross-sectional view, is located between the circulation tool 66 and the packer 68.

Ball catcher 62 is as described hereinbefore with reference to FIG. 4 having the second bore 72 centrally located on the longitudinal axis of the tool string 60. First bore 74 is thus offset from the longitudinal axis.

Circulation tool 66 is a conventional drop ball circulation tool having radially ports 76 which can circulate fluid out of the tool when an inner sleeve having matching radial ports is suitably aligned. The inner sleeve is moved by virtue of a drop ball, the drop ball being expelled from the tool after the tool has been actuated. The tool may further provide cyclic circulation in an on-off or off-on configuration by repeated dropping of balls of a diameter which is substantially equal to the diameter of the first bore 74.

Packer 68 is as known in the art and operated by virtue of a drop ball having a diameter equal to or smaller than the diameter of the second bore 72.

In use, the tool string 60 is run in well bore 64. At any desired location either the circulation tool 66 or the packer 68 can be actuated by dropping a suitable sized ball into the tool string 60. Packer 68 can be operated first if desired. Indeed either tool 66,68 can be operated in any sequence by virtue of choice of diameter of the drop ball chosen. The drop balls will be collected in the ball catcher 62 if they have a diameter equal to the diameter of the first bore 74 and have been used to actuate the circulation tool 66. The balls will be caught in the lower ball catcher 70 if they have been used to actuate the packer 68. Actuation of the packer is thus done from the surface of the well bore and is independent of the operation of the circulation tool 66. Further as the second bore 76 is located on the longitudinal axis a wireline 78 can be passed through the tool string 60 to a position below the ball catcher 62.

Wireline 78 could be a string including further tools. For example, tools required to recover radioactive sources, downhole monitoring tools, explosive deployment tools and gyro tools for directional surveying.

The principal advantage of the present invention is that it provides a ball catcher which can selectively retain or allow balls to pass therethrough. A further advantage of the present invention is that it may provide a ball catcher in which a wireline or tool deploying string can pass therethrough. A yet further advantage of the present invention is that it provides a ball catcher which permits a drop ball actuated tool located below it to be operated before a drop ball actuated tool located above it.

It will be appreciated by those skilled in the art that modifications may be made to the invention hereindescribed without departing from the scope thereof. In particular the diameter of the second bore can be of any diameter to suit the flow path required through the ball catcher. The ball catcher may also be incorporated as an integral part of a tool to allow selective operation of the tool without interrupting operation of other tools located at any point on the tool string.

The invention claimed is:

1. A ball catcher for selectively retaining drop balls in a tool string, the ball catcher comprising a substantially cylindrical body having a main bore running axially therethrough, at least a portion of the main bore being restrained to a first and a second bore running axially therethrough, the first and second bores being parallel and wherein the first bore includes restriction means at an end thereof, wherein the first and second bores are partially overlapping to provide a channel therebetween.

2. The ball catcher as claimed in claim 1, wherein the main bore is located centrally on the body.

3. The ball catcher as claimed in claim 1, wherein the portion of the main bore includes an entry port, the entry port having a first aperture equal to the diameter of the first bore and a second aperture having a diameter less than the diameter of the first bore, the apertures being aligned with the first and second bores respectively.

4. A method of selectively retaining drop balls in a tool string, comprising the steps:

(a) inserting in a tool string a ball catcher including first and second parallel bores passing therethrough, the first bore having retaining means, the bores including an overlapping portion to provide a channel therebetween;

(b) dropping a first ball of a first diameter through the tool string;

(c) directing the first ball into the first bore; and (d) retaining the first ball in the first bore.

5. The method as claimed in claim 4, wherein the method further includes the steps of:

(a) dropping a second ball of a second diameter, the second diameter being smaller than the first diameter through the tool string;

(b) directing the second ball into the first bore;

(c) passing the second ball through the channel into the second bore; and (d) releasing the second ball from the ball catcher into the tool string.

6. The method as claimed in claim 4, wherein the method further includes the steps:

(a) dropping a second ball of a second diameter, the second diameter being smaller than the first diameter through the tool string;

(b) passing the second ball through the second bore; and (c) releasing the second ball from the ball catcher into the tool string.

7. The method as claimed in claim 4, wherein the method includes the step of passing a tool through the second bore into the tool string below the ball catcher.

8. The method as claimed in claim 4, wherein the method includes the step of actuating a tool above the ball catcher with the first ball.

9. The method as claimed in claim 5, wherein the method includes the step of actuating a tool below the ball catcher with the second ball.

10. A ball catcher for selectively retaining drop balls in a tool string, the ball catcher comprising a substantially cylindrical body having a main bore running axially therethrough, at least a portion of the main bore being restrained to a first and a second bore running axially therethrough, the first and second bores being parallel and wherein the first bore includes restriction means at an end thereof, wherein the portion of the main bore includes an entry port, the entry port having a first aperture equal to the diameter of the first bore and a second aperture having a diameter less than the diameter of the first bore, the apertures being aligned with the first and second bores respectively, and wherein the entry port is inclined with respect to the main bore.

11. A ball catcher for selectively retaining drop balls in a tool string, the ball catcher comprising a substantially cylindrical body having a main bore running axially therethrough, at least a portion of the main bore being restrained to a first and a second bore running axially therethrough, the first and second bores being parallel. wherein the first bore includes restriction means at an end thereof and the first and second bores are partially overlapping to provide a channel therebetween, and wherein the portion of the main bore includes an entry port, the entry port having a first aperture equal to the diameter of the first bore and a second aperture having a diameter less than the diameter of the first bore, the apertures being aligned with the first and second bores respectively, and wherein the second aperture has a diameter substantially equal to a width of the channel.

12. A ball catcher for selectively retaining drop balls in a tool string, the ball catcher comprising a substantially cylindrical body having a main bore running axially therethrough, at least a portion of the main bore being restrained to a first and a second bore running axially therethrough, the first and second bores being parallel and wherein the first bore includes restriction means at an end thereof, wherein the first and second bores are partially overlapping to provide a channel therebetween, and wherein said portion of the main bore is restrained by a third bore coaxially aligned with the first bore and having a diameter less than the diameter of the first bore.

13. A ball catcher for selectively retaining drop balls in a tool string, the ball catcher comprising a substantially cylindrical body having a main bore running axially therethrough, at least a portion of the main bore being restrained to a first and a second bore running axially therethrough, the first and second bores being parallel and wherein the first bore includes restriction means at an end thereof, wherein the first and second bores are partially overlapping to provide a channel therebetween, and wherein the second bore is located centrally on the body.

14. A method of selectively retaining drop balls in a tool string, comprising the steps:

(a) inserting in a tool string a ball catcher including first and second parallel bores passing therethrough, the first bore having retaining means, the bores including an overlapping portion to provide a channel therebetween;

(b) dropping a first ball of a first diameter through the tool string;

(c) directing the first ball into the first bore;

(d) retaining the first ball in the first bore;

(e) dropping a second ball of a second diameter, the second diameter being smaller than the first diameter through the tool string;

(f) directing the second ball into the first bore;

(g) passing the second ball through the channel into the second bore; and (h) releasing the second ball from the ball catcher into the tool string.

15. The method as claimed in claim 14, wherein the method includes the step of actuating a tool below the ball catcher with the second ball.

16. A method of selectively retaining drop balls in a tool string, comprising the steps:

(a) inserting in a tool string a ball catcher including first and second parallel bores passing therethrough, the first bore having retaining means, the bores including an overlapping portion to provide a channel therebetween;

(b) dropping a first ball of a first diameter through the tool string;

(c) directing the first ball into the first bore;

(d) retaining the first ball in the first bore;

(e) dropping a second ball of a second diameter, the second diameter being smaller than the first diameter though the tool string;

(f) passing the second ball through the second bore; and (g) releasing the second ball from the ball catcher into the tool string.

17. The method as claimed in claim 16, wherein the method includes the step of actuating a tool below the ball catcher with the second ball.

* * * * *